US005671706A

United States Patent [19]

Frost et al.

[11] Patent Number: 5,671,706

[45] Date of Patent: Sep. 30, 1997

[54] VARIABLE VALVE TIMING

[75] Inventors: Derek Frost, Leigh-on-Sea; Timothy Mark Lancefield, Bicester, both of United Kingdom

[73] Assignee: Mechadyne Limited, Kirtlington, United Kingdom

[21] Appl. No.: 656,178

[22] PCT Filed: Dec. 6, 1994

[86] PCT No.: PCT/GB94/02669

§ 371 Date: Jun. 5, 1996

§ 102(e) Date: Jun. 5, 1996

[87] PCT Pub. No.: WO95/16108

PCT Pub. Date: Jun. 15, 1995

[30] Foreign Application Priority Data

Dec. 8, 1993 [GB] United Kingdom ..... 9325168

[51] Int. Cl.[6] ..... F01L 13/00; F01L 1/344

[52] U.S. Cl. ..... 123/90.17; 123/90.31; 74/568 R; 251/251

[58] Field of Search ..... 123/90.15, 90.16, 123/90.17, 90.18, 90.31, 90.6; 74/567, 568 R; 251/251

[56] References Cited

U.S. PATENT DOCUMENTS

| | | | |
|---|---|---|---|
| 3,144,009 | 8/1964 | Goodfellow et al. | 123/90.17 |
| 4,771,742 | 9/1988 | Nelson et al. | 123/90.17 |
| 5,199,393 | 4/1993 | Baldassini | 123/90.17 |
| 5,361,736 | 11/1994 | Phoenix et al. | 123/90.17 |
| 5,365,896 | 11/1994 | Hara et al. | 123/90.17 |
| 5,417,186 | 5/1995 | Elrod et al. | 123/90.31 |

FOREIGN PATENT DOCUMENTS

93/25802 12/1993 WIPO .

*Primary Examiner*—Weilun Lo
*Attorney, Agent, or Firm*—Smith-Hill and Bedell

[57] ABSTRACT

A valve operating mechanism comprises a hollow shaft (10), a sleeve journalled on the hollow shaft and having a cam, a coupling yoke (16) connected by a first pivot pin (18) to the hollow shaft (10) and by a second pivot pin (20) to the sleeve and means for pivoting the yoke (16) to effect a phase change between the hollow shaft (10) and the sleeve, wherein the means for pivoting the yoke (16) comprises an actuating rod (24) slidably received in the hollow shaft (10), a cam surface on the actuating rod (24) and a plunger (22) passing through a generally radial bore in the hollow shaft (10) to cause the yoke (16) to pivot in response to axial movement of the actuating rod (24).

9 Claims, 4 Drawing Sheets

VARIABLE VALVE TIMING

Figure 1:
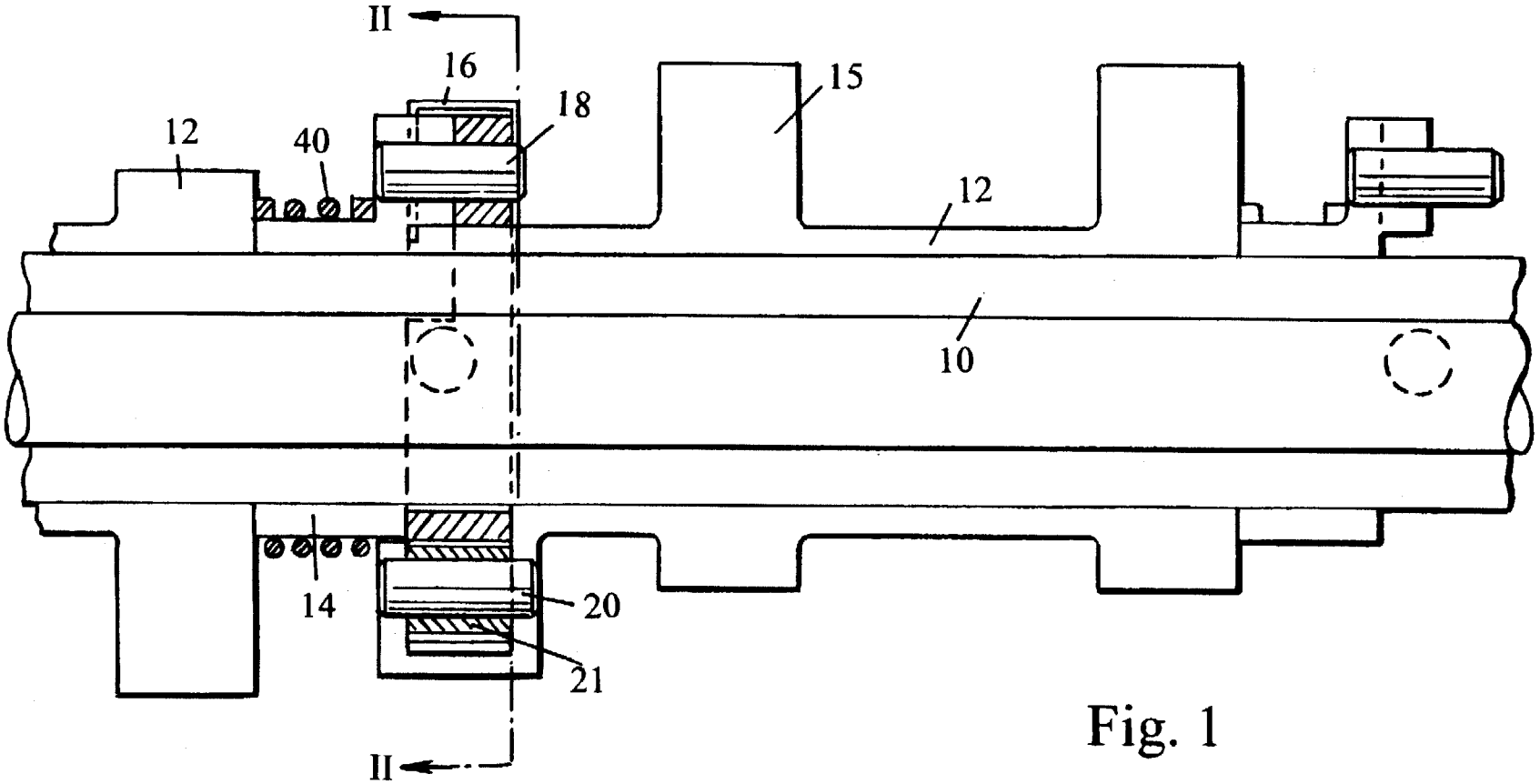

The present invention relate to a valve train for an internal combustion engine that permits the crank angles at which the valves open and close to be varied. The invention can be applied both to achieve an equal phase shift of the opening and closing crank angles so as not to change the duration of the valve event, or to bring about a relative change in the phases of the opening and closing times of a valve so as to vary the duration of the valve event.

As is well known, valve timing has a significant effect on engine performance and the optimum setting varies with engine operating conditions. To optimise performance under different operating conditions, it is necessary to be able to vary the valve timing.

The simplest form of variable valve timing is achieved by varying the phase of the inlet valves relative to the exhaust valves. More complex systems seek to vary the duration of valve events, which is equivalent to using a cam with a different profile.

Various variable valve timing systems have been proposed in the past that achieve either variable phase shift or variable valve event duration. These systems have suffered from various problems. Some, though feasible, have been costly to implement and some have developed excessive friction or not proved to be reliable. Furthermore, many could not be fitted as a modification to existing engines and required much of the valve train and cylinder head to be redesigned.

The most relevant prior art known to the Applicants is GB-A-2,247,061. This shows a cam formed on a sleeve that may rotate relative to the driven camshaft. Coupling between the cam sleeve and the camshaft is by means of a spring biased plunger that engages in a recess in the cam sleeve to act as a form of spring biased lost motion coupling. This permits the cam sleeve to be moved by the reaction forces exerted by the valve spring to allow the duration of the valve event to be collapsed under certain operating conditions.

According to the present invention, there is provided a valve operating mechanism comprising a hollow shaft, a sleeve journalled on the hollow shaft and fast in rotation with a cam, a coupling yoke connected by a first pivot pin to the hollow shaft and by a second pivot pin to the sleeve and means for moving the yoke radially to effect a phase change between the hollow shaft and the sleeve, wherein the means for moving the yoke radially comprise an actuating rod slidably received in the hollow shaft, a cam surface on the actuating rod and a plunger passing through a generally radial bore in the hollow sleeve to cause the yoke to move radially in response to axial movement of the actuating rod.

Preferably two plungers are provided to move the yoke in opposite directions.

If the two plungers drive the yoke without any free play, then a variable phase shift is achieved by moving the actuating rod. On the other hand, if there is free play between the ends of the plungers and the yoke, then this free play allows the yoke to accelerate once the lobe of the cam passes the full lift position of the valve, thereby allowing the valve opening event to be collapsed.

Figure 2:
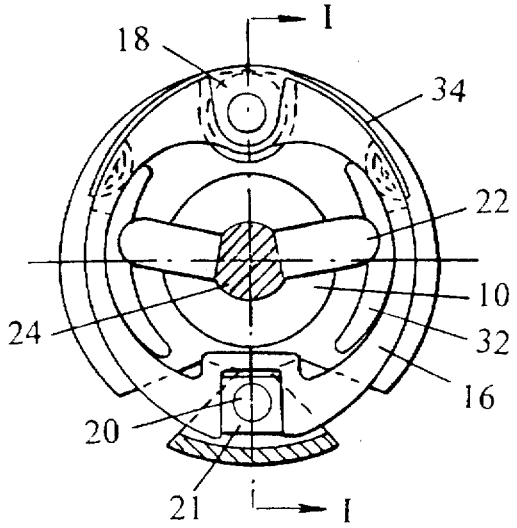
Figure 3:
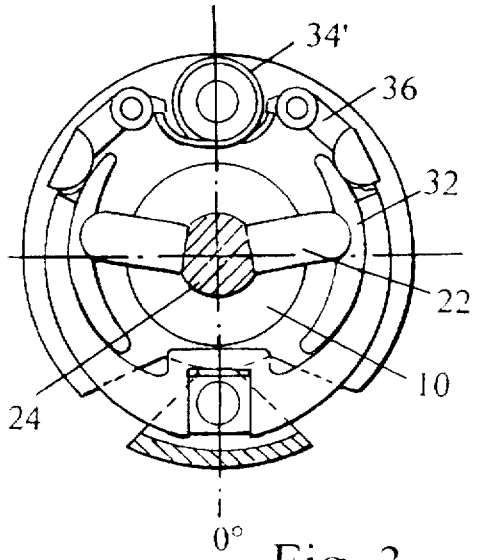
Figure 4:
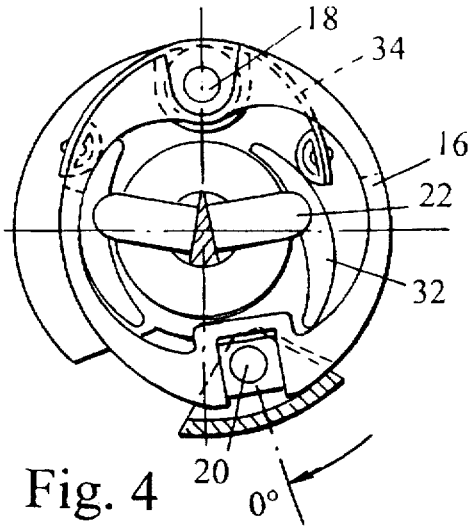
Figure 5:
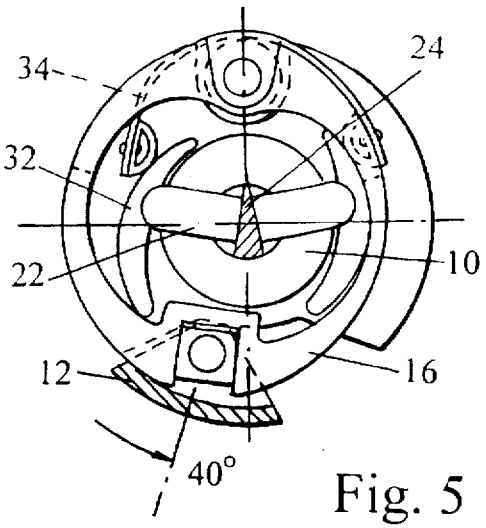
Figure 7:
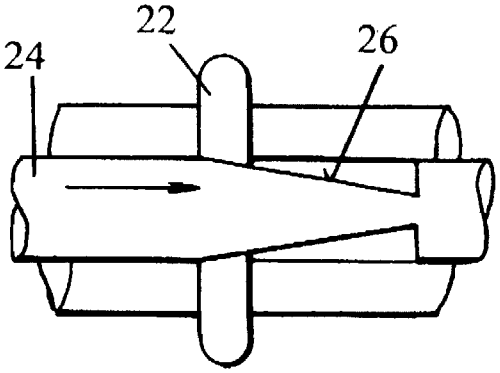
Figure 6:
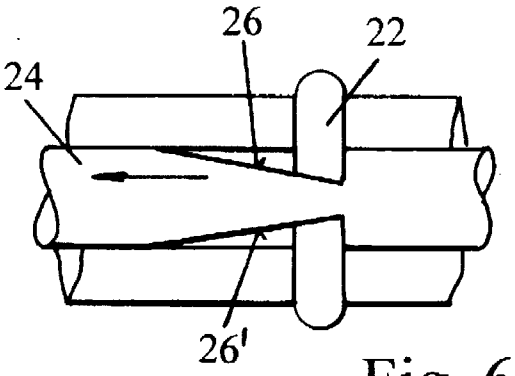
Figure 8:
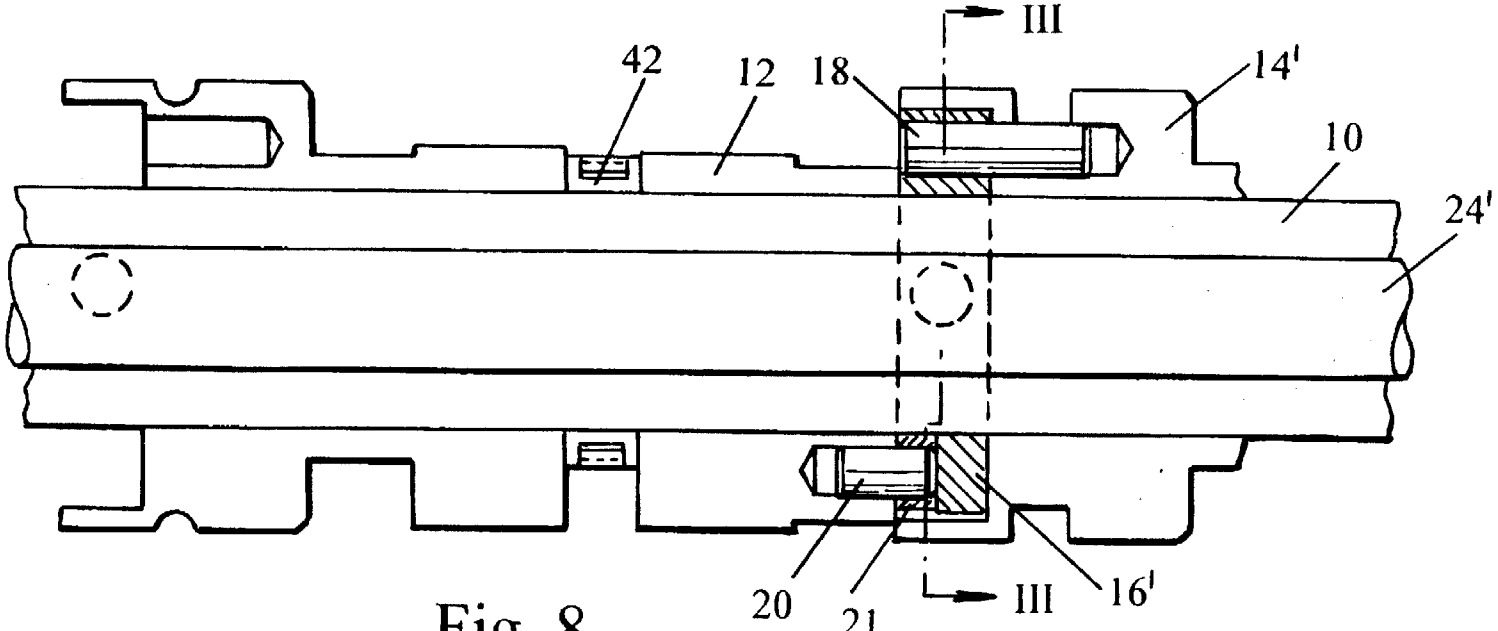
Figure 9:
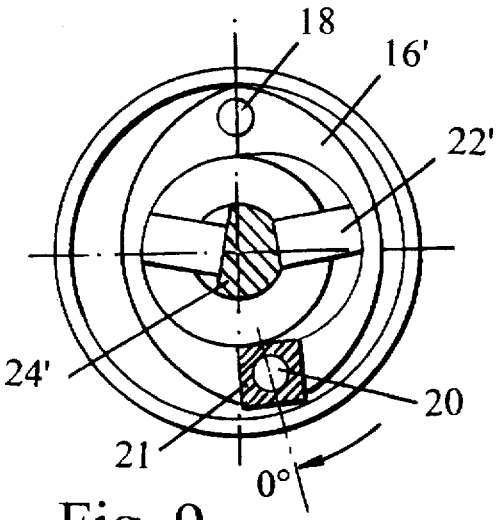
Figure 10:
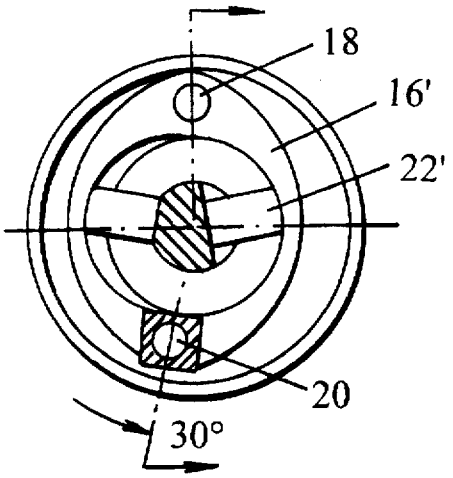
Figure 13:
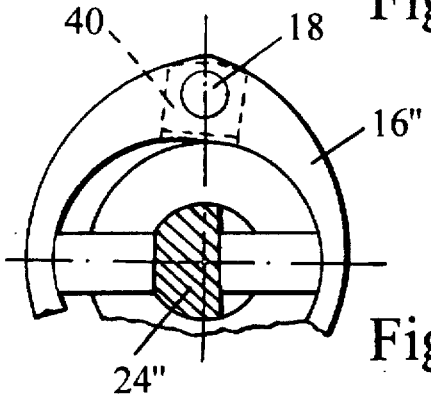
Figure 11:
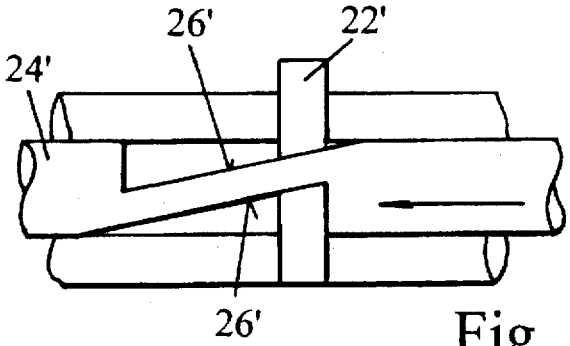
Figure 12:
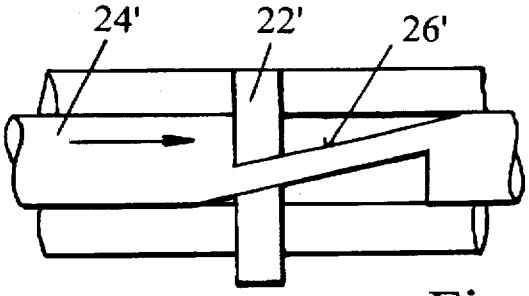

The invention will now be described further, by way of example, with reference to the accompanying drawings, in which:

FIG. 1 is a section through a camshaft along the section plane I—I in FIG. 2 for an engine with variable event timing, FIG. 2 is a section through the plane II—II in FIG. 1, passing through the axis of the camshaft, showing both plungers in their fully extended position, FIG. 3 is a section similar to that of FIG. 2, showing an alternative embodiment of the invention, FIGS. 4 and 5 show sections similar to that of FIG. 2 that demonstrate the manner in which variable event timing is achieved by moving the plungers, FIGS. 6 and 7 show the movement of the plungers by the actuating rod in order to achieve the desired variation of the valve event in FIGS. 4 and 5, FIG. 8 is a view similar to that of FIG. 1 of an embodiment achieving only variable phasing without modifying the duration of the valve event, FIGS. 9 and 10 are sections similar to the sections of FIGS. 4 and 5, taken along the section plane III—III in FIG. 8 and showing the manner in which variable phasing of the cam is achieved, FIGS. 11 and 12 are views similar to those of FIGS. 6 and 7 show the profile of the cams of the actuating rod in the embodiment of FIG. 8, and FIG. 13 shows a detail of an alternative embodiment in which sliding blocks are associated with both of the pivots of the yoke to permit the yoke to float and find its own position.

In FIGS. 1 to 7, a camshaft assembly is illustrated that comprises a hollow shaft 10 and a collar 14 fast in rotation with the hollow shaft 10. A sleeve 12 is journalled about the hollow shaft 10 and carries one or more cams 15.

Coupling between the cam sleeve 12 and the collar 14 is established through a yoke 16 that surrounds the hollow shaft 10 and is connected by a pivot pin 18 to the collar 14. The yoke 16 is also coupled by pivot pin 20 and a sliding block 21 to the sleeve 12. The yoke 16 can move from side to side, i.e. radially, relative to the shaft 10 under the action of the reaction forces on the cams 15. The extent of such movement is limited by means of plungers 22 that pass through radial bores in the shaft 10 and rest on cam surfaces 26 (see FIGS. 6 and 7) of an actuating rod 24 that can slide axially within the hollow shaft 10. Axial movement of the rod 24, as seen from FIGS. 6 and 7, symmetrically moves the plungers 22 radially and these in turn act by way of arcuate shoes 32 on the inner surface of the yoke 16.

In use, when the engine is operating at high speed or high load the actuating rod 24 moves into the position shown in FIG. 7, which corresponds also to the position illustrated in FIG. 2. The plungers 22 are fully extended and provide a firm coupling with no lost motion between the collar 14 and the cam sleeve 12 so that the duration of the valve event is fixed.

Under idle and low load conditions, the actuating rod 24 is moved towards the position shown in FIG. 6 in which the plungers 22 are fully retracted. In this position of the plungers 22, depending upon the net torque acting on the cam sleeve 12, the yoke 16 may adopt either one of the positions shown in FIGS. 4 and 5. Initially, as the valve commences to open the yoke 16 it lies the position shown in FIG. 4 in which the cam is fully retarded to its reference phase, shown in the drawing as being 0°. Until the valve is fully open, the yoke 16 remains in this position but after passing the full lift position the yoke 16 commences movement towards the position shown in FIG. 5 in which it may be advanced as much as 40°.

The change-over from the position shown in FIG. 4 to that in FIG. 5 is caused by the force resulting from the reaction of the valve spring. The resultant torque causes the shoes 32 to rock about the ends of the plungers 22, while the biasing leaf spring 34 located about the pivot pin 18 ensures that contact is maintained at all times. There is therefore permanent contact between the shoes 32 and the inner surfaces of the yoke 16, the line of contact rolling as the yoke moves between its end positions. Such rolling of the point of contact results in more silent operation, and the noise suppression is further improved by the oil layer at the point of contact which is progressively swept to the center. When the shoes are fully seated on the inner surface of the yoke 16, they act as positive stops preventing any further movement of the yoke. The purpose of the leaf spring 34 is to ensure that the shoes 32 always remain in contact with the inner surface of the yoke and the ends of the plungers 32.

After the valve has been fully seated it is necessary to return the yoke 16 to the position shown in FIG. 4 in readiness for the next operating cycle. This is effected by means of a coiled spring 40 fitted about the collar 14 that acts to bias the cam sleeve 12 towards its reference phase position.

The embodiment of FIG. 3 from that of FIGS. 2, 4 and 5 in the manner in which a spring force is applied to the shoes 32. In place of the leaf spring 34 acting directly on the ends of the shoes 32, the force of a coil spring 34' is relayed to the shoes 32 by a pair of rockers 36 mounted about fixed pivots. In this embodiment coil springs offer the advantage of being more fatigue resistant and reliable than leaf springs but there is a cost penalty in providing the additional rockers 36.

The camshaft assembly of FIG. 1 is assembled progressively by sliding the cam sleeves 12 and the collars 14 over the hollow shaft 10. The collars are keyed to the shaft by roll pins or Woodruff keys that do not interfere with the passage of the cam sleeves 12 over the hollow shaft 10. The plungers 22 are inserted radially through the holes in the hollow shaft 10 to make contact with the cams 26 of the actuating rod 24 that is initially inserted into the hollow shaft and thereafter the shoes 32 are placed over the ends of the plungers 22. The yoke 16 located on the sliding block 21 of the associated cam sleeve 12 is then slid as a complete sub-assembly to locate about the pin 18, at the same time retaining the shoes 32.

The embodiment of FIGS. 8 to 12 is in many respects the same as the embodiment of FIGS. 7 and to avoid repetition like components have been allocated like references numerals with the addition of a prime where the element has been modified.

The camshaft assembly of FIGS. 8 to 12 differs from that of FIGS. 1 to 7. First, the actuating rod 24' in this second embodiment is designed to provide a variable phase shift without varying the duration of the valve event. Second, the shoes at the ends of the plungers have been omitted to save space and cost. Noise in the case of this second embodiment is not as serious a problem as when lost motion is created to cause collapse of the valve event and such small amounts of noise as may result from wear can be mitigated by automatic adjustment of the length of one or both of the plungers. This can be done mechanically or by using a construction analogous to the well known hydraulic tappets.

In FIG. 8, the hollow camshaft 10 is keyed to a collar 14' which in this case is the inner race of a camshaft bearing. A pin 18 is driven into the collar 14' and on it there is pivoted a yoke 16' which is shaded in FIG. 8. A slider 21 slidable in a radial groove in the yoke 16' receives a pin 20 that is driven into a cam sleeve 12 rotatably supported on the hollow shaft. An actuating rod 24' passes along the centre of the hollow shaft 10 and has cam surfaces 26' engaged by plunger 22' which in this case, as shown in FIGS. 9 and 10, make direct contact with the inner surface of the yoke 16'.

Movement of the yoke 16' from side to side as seen from FIGS. 9 and 10 varies the phase of the cam sleeve 12 relative to the collar 14'. This movement is effected by sliding the actuating rod 24' as shown in FIGS. 11 and 12. The distance between the cam surfaces 26' in this embodiment is constant and as the plungers move they merely shift the yoke 16' from side to side to create the desired phase shift without altering duration of the valve event.

The camshaft illustrated in FIG. 8 is again assembled from one end as previously described in relation to the first embodiment but in this case, assuming that assembly is carried out from the right in FIG. 8, it is necessary to be able to move the sleeve 12 a little further to the right than its final desired position to permit insertion of the plungers 22'. To permit such movement, a split spacer 42 is provided which is located about the hollow shaft after both the adjacent phase shifting mechanisms have been assembled.

The cam profiles 26' on the actuating rod 24' as shown in FIG. 9 need to take account of the changing attitude of the yoke 16' as it pivots about the pin 18. In the case of the alternative embodiment illustrated in FIG. 13, the pin 18 is also associated with a slider block 40 which allows the yoke 16" to float and permits the cam surfaces on the actuating rod 24" to be parallel to one another.

The yoke coupling used in the present invention allows a multiplication of the angular distance that the cam may move by locating the pivot of the yoke outside the camshaft and thereby increasing its radius. The yoke now allows the cam on its smaller connecting radius to move further than its own limits.

Thus, as described in the second embodiment, it is possible to package such a yoke coupling within a bearing housing, with a radius equal to the height of the cam, that will achieve the range of valve timings required to affect engine operation advantageously under all conditions, such as the modulation of internal EGR, thus making it possible to retro-fit into many engine configurations. The greater the housing and yoke radius the greater the degree of multiplication. Up to 40° can be achieved within most housing diameters that can be packaged within a tunnel mounted camshaft bearing. This represents up to 80° against the crankshaft.

In the present invention, by utilising space within large type bearings, or where radial space exists to accommodate the narrow couplings between the bearings, it is possible to package couplings to individually change both inlet and exhaust cams on a single camshaft assembly, even to the extent of mixing event change (VET) and phase shift (VVT). Additionally, it is possible to control individual lobes independently on a multi-valve inlet or exhaust camshaft on twin cam applications and simulate a VET effect using only phase shifters. This is a compromise approach but offers significant benefits over pure phase shift which characterises the flexibility inherent in the system.

However it should be noted that the different angular positions of the cams (inlet/exhaust) and the effect this has on control plunger positions, may necessitate the ramps on the actuating rod being circular in section to accommodate both the angular and radial shift. This will weaken the actuating rod slightly but not to the extent that it would cause a problem.

The lost motion approach to changing the duration of the cam period sets the invention apart from other VET systems. Whereas other methods need only take account of the peak forces involved, the lost motion approach must also take account of any torque forces transmitted back through the cams after the valve has been reseated.

Poppet valve trains are operated by cams which have been given a profile that opens and closes the valve within a required period. These profiles start and finish with ramp angles which can be seen as lead-ins to the profile and serve to minimise stresses as the valve is lifted off its seat or ensure minimum impact velocity as it is reseated. Ramp angles by nature only work one way which means that the cam drive the valve but the valve cannot drive the cam. Contact radii, beyond which the valve can effectively drive the cam, start a degree or two outside the ramp angle. Clearly it is necessary for the forces being returned from the valve spring to complete the lost motion before the cam follower reaches the ramp angle of the cam. To achieve this, particularly when large event changes are required, the inertia of the coupling, along with all influencing spring forces, must be kept to a minimum. In particular, the main return spring must not deliver an angular force that will lift the valve off its seat through the ramp angle.

The use of a yoke to multiply the angular distance that the cam may move also allows compliance. This feature is helpful to the yoke's dynamic operation but will be particularly beneficial to the VET assembly in its locked up mode and the phase changing system (VVT) where continuous contact is necessary between the plungers and yoke. In both applications, minor tolerance variation across the plungers can be taken up by the yoke's ability to yield very slightly across its thinner sections around the plungers.

Both the VVT and VET systems may utilise the same control approach. A hydraulic or a mechanical servo device can be incorporated into the cam shaft driving sprocket and this can be arranged to move the actuating rod either as a continuous process, or as a number of discrete positions, to match the varying engine needs. An engine management system would be programmed to control the servo system. All valve train systems need torsionally sturdy camshaft designs. To facilitate this, the present invention has been built around a very strong and stiff main shaft with the design of all moving parts directed towards preserving this sturdy characteristic, thus ensuring maximum durability and reliability. Being a common basic design for all systems, this general characteristic is inherent in all applications, regardless of how they may be packaged. Design for manufacture has been applied to permit the application of the latest manufacturing and assembly technology thereby ensuring a reliable and economic product.

We claim:

1. A valve operating mechanism comprising a hollow shaft, a sleeve journalled on the hollow shaft and having a cam, a coupling yoke connected by a first pivot pin to the hollow shaft and by a second pivot pin to the sleeve and means for pivoting the yoke to effect a phase change between the hollow shaft and the sleeve, wherein the means for pivoting the yoke comprise an actuating rod slidably received in the hollow shaft, a cam surface on the actuating rod and a plunger passing through a generally radial bore in the hollow shaft and being in operative contact with said cam surface and the yoke to cause the yoke to pivot in response to axial movement of the actuating rod.

2. A valve operating mechanism as claimed in claim 1, wherein two plungers are provided to pivot the yoke in opposite directions.

3. A valve operating mechanism as claimed in claim 2, wherein the cam surfaces on the actuating rod are such that the two plungers drive the yoke substantially without free play at any time, whereby a variable phase shift is achieved by moving the actuating rod.

4. A valve operating mechanism as claimed in claim 1, wherein the cam surfaces on the actuating rod are such that free play is present between the ends of the plungers and the yoke, whereby the yoke is allowed to accelerate once a valve lifting flank of the cam passes the stem of the engine valve driven by the cam, thereby allowing the valve opening event to be collapsed.

5. A valve operating mechanism as claimed in claim 1, wherein arcuate shoes are provided between the plungers and the yoke.

6. A valve operating mechanism as claimed in claim 5, wherein means are provided to apply a resilient bias to the arcuate shoes to pivot the arcuate shoes about the ends of the plungers so as to maintain one end of each arcuate shoe in permanent contact with the yoke.

7. A valve operating mechanism as claimed in claim 6, wherein the means for applying a resilient bias comprise a leaf spring.

8. A valve operating mechanism as claimed in claim 6, wherein the means for applying a resilient bias comprise a coil spring acting on the ends of the arcuate shoes by way of respective rockers.

9. An internal combustion engine having a valve operating mechanism as claimed in claim 1.

* * * * *